US008042974B2

(12) United States Patent
Sherman et al.

(10) Patent No.: US 8,042,974 B2
(45) Date of Patent: Oct. 25, 2011

(54) REMOVABLE, ROTATABLE GOBO HOLDER ASSEMBLY

(75) Inventors: Kenneth L. Sherman, Irvine, CA (US); Charles Davies, Pasadena, CA (US); Toby Velazquez, Yorba Linda, CA (US)

(73) Assignee: American DJ Supply, Inc., Los Angeles, CA (US)

( * ) Notice: Subject to any disclaimer, the term of this patent is extended or adjusted under 35 U.S.C. 154(b) by 0 days.

(21) Appl. No.: 12/738,973

(22) PCT Filed: Oct. 23, 2008

(86) PCT No.: PCT/US2008/081009

§ 371 (c)(1),
(2), (4) Date: Apr. 20, 2010

(87) PCT Pub. No.: WO2009/055607

PCT Pub. Date: Apr. 30, 2009

(65) Prior Publication Data

US 2010/0208475 A1 Aug. 19, 2010

Related U.S. Application Data

(60) Provisional application No. 60/982,090, filed on Oct. 23, 2007.

(51) Int. Cl.
*F21V 17/02* (2006.01)

(52) U.S. Cl. ..... 362/321; 362/282; 362/293; 362/319; 362/418; 359/821; 359/892

(58) Field of Classification Search ..... 362/282–283, 362/293, 319, 321, 418; 359/813–814, 821–822, 359/889, 892

See application file for complete search history.

(56) References Cited

U.S. PATENT DOCUMENTS

| | | | |
|---|---|---|---|
| 6,241,366 | B1 | 6/2001 | Roman et al. |
| 6,601,973 | B2 | 8/2003 | Rasmussen et al. |
| 6,971,770 | B2 | 12/2005 | Rasmussen et al. |
| 7,222,997 | B2 | 5/2007 | Rasmussen et al. |
| 7,370,990 | B2 | 5/2008 | Jurik |
| 7,502,535 | B2 | 3/2009 | Harris |
| 2008/0158884 | A1 | 7/2008 | Joergensen et al. |
| 2008/0175004 | A1 | 7/2008 | Jurik |

FOREIGN PATENT DOCUMENTS

WO 2004/046607 A1 6/2004

OTHER PUBLICATIONS

PCT International Search Report for International Application No. PCT/US2008/81009 dated Dec. 16, 2008, 1 pg. United States.

Coernar, S.P.A., May 30, 2005 Italian Declaration by Fausto Orsati for a rotatable gobo holder system designed in Italy and on sale in the United States in 1997, Italy.

Elation Lighting, Inc., Model Power Spot 700 CMY, Rev1.0, Oct. 17, 2006, United States.

Notification of Transmittal of the International Preliminary Examining Authority, International Preliminary Report on Patentability dated Jul. 26, 2010 for International Application No. PCT/US08/81009 from Commissioner for Patents, pp. 1-9, Alexandria, Virginia, United States.

*Primary Examiner* — Stephen F Husar
*Assistant Examiner* — Meghan Dunwiddie
(74) *Attorney, Agent, or Firm* — Kenneth L. Sherman, Esq.; Michael Zarrabian, Esq.; Myers Andras Sherman & Zarrabian LLP

(57) ABSTRACT

The invention provides a system and method for maintaining removable, rotatable gobo holders in place on a fixed baseplate within an effects lighting fixture. In the first preferred embodiment, a gobo platform includes a rotatable baseplate having at least one aperture and at least one removable, rotatable gobo holder including points of active retention configured to retain the removable, rotatable gobo holder on the rotatable baseplate.

29 Claims, 13 Drawing Sheets

REMOVABLE, ROTATABLE GOBO HOLDER ASSEMBLY

CROSS-REFERENCE TO RELATED APPLICATIONS

This application is a national stage application under 35 U.S.C. section 371 of PCT/US2008/081009 filed Oct. 23, 2008, which claims priority under 35 U.S.C. section 119(e) to U.S. Provisional Patent Application Ser. No. 60/982,090, filed Oct. 23, 2007. Both applications, PCT/US2008/081009 and U.S. Ser. No. 60/982,090, are incorporated herein by reference in their entirety.

BACKGROUND OF THE INVENTION

1. Field of the Invention

The present invention relates generally to lighting effects fixtures, and in particular to an improved rotatable gobo holder assembly which removably retains the rotatable gobo holders to a rotatable gobo platform.

2. Background Information

Prior art U.S. Pat. No. 6,601,973 (the '973 Patent) shows a removable, rotatable gobo holder assembly which attaches a removable, rotatable gobo holder into at least one of several apertures within a rotatable baseplate. The rotatable baseplate includes a spring retainer which holds multiple removable gobo holders to the base plate to interact with gearing assemblies. The '973 Patent assembly requires each of its relative pieces to fit in a very coordinated manner. The coordinated manner of attachment allows each gobo holder to be removed and replaced, causes each gobo holder to engage a single gear assembly and thereby rotate its gobo caused by the rotation of the single gear assembly, and for the entire rotatable baseplate to be held and be rotatable to move one of its several gobos into and out of a light path in a controlled manner.

The spring retainer fixed to the rotatable baseplate of the '973 Patent assembly is meant to removeably mate with the gobo holders so the gobos can be removed and replaced from time to time. However, each time the '973 Patent's spring retainer is pulled back to allow a gobo holder to be replaced in an aperture of the baseplate, the spring retainer loses tensioning strength. Over time the spring retainer will stop providing enough strength to adequately hold the gobo holders in place within the apertures in the baseplate.

As the single spring retainer attached to the rotatable baseplate loses tensioning strength, it will stop retaining one or more of the removable gobo holders in a fixed position and the operational capacity of the entire assembly will diminish because the assembly will only hold 5 out of 6 gobos and then 4 out of 6 gobos, etc. In order to address this problem, then the entire assembly must be removed and the baseplate along with its fixed spring retainer must be replaced. This is often a difficult chore since the entire lighting fixture may be held hundred's of feet in the air above a stage or otherwise out of reach.

Further, in the prior art rotatable gobo holder assembly of the '973 Patent, each gobo holder is required to have a flange around its circumference. The flange must mate with the spring retainer in a particular way so that all of the parts carefully fit in place and in turn mate. This includes the gobo holder fitted within the aperture of the baseplate, and the flange fitted within the spring retainer and the gear assemblies fitting together to allow the forces of rotation to be translated throughout.

Another prior art rotatable gobo holder is found in U.S. Pat. No. 7,370,990 and US Patent Publication No 20080175004

(the '990 Structure). In the '990 Structure, "lamellas" or tabs attached to the rotatable gobos fit underneath flexible fingers of a central holding means fixed to a carrier disc. The '990 Structure has similar problems as the '973 Patent structure. Although the '990 Structure has less of a guide mechanism to fit the rotatable gobo holder onto the carrier disc and thereby engage the main gear assembly, the flexible fingers are susceptible to being stretched and losing tensioning strength thereby requiring replacement of the entire carrier disc assembly.

In application, there have been several implementations of rotatable gobo holder assemblies where the rotatable gobo holders are held in place by flanges or tabs engaging a spring retainer or flexible fingers fixedly attached to the rotating carrier. These include Martin Professional Mach 2000 series, ROBE Lighting's, Color Spot Series Products, and Elation Lighting's Model Year 2007 and earlier, Power Spot 700 Products. These products are generally called moving head light fixtures.

SUMMARY OF THE INVENTION

The preferred embodiments of the present invention provide a removable, rotatable gobo holder assembly where the removable gobo holder itself provides the force of active retention to removeably mate the removable gobo holder with a rotatable baseplate. By moving the active point(s) or forces of retention completely onto the removable, rotatable gobo holder itself, the preferred embodiments of the present invention are able to eliminate the spring retainer or any type of active retention mechanism from the rotatable baseplate, i.e., fixed carrier assembly. In the preferred embodiments of the present invention, the rotatable baseplate merely acts to receive the rotatable gobo holders. The preferred embodiments of the present invention provide at least two (2) points or forces of active retention, but other embodiments of the present invention are capable of operating with only a single force of active retention The first and second preferred embodiments of the present invention incorporate a retention spring into the removable gobo holder itself so that the retention spring removably mates with the rotatable baseplate. By placing a retention spring onto the removable gobo holder and/or providing multiple points of active retention on the removable gobo holder, the spring retainer is removed from the rotatable baseplate thereby reducing cost and complexity of manufacture as well as extending the life of the rotatable baseplate and the entire lighting fixture itself. Further, if the retention spring on a removable gobo holder of the first and second preferred embodiments of the present invention loses tension, either the retention spring can be easily replaced on the removable gobo holder or the removable gobo holder itself can be easily replaced without effecting the entire assembly or the lighting fixture itself.

Yet a third embodiment of the present invention provides a rotatable gobo platform including a rotatable baseplate having at least one aperture, and at least one gobo including at least two points of active retention configured to retain the at least one rotatable gobo holder on the rotatable baseplate.

A fourth embodiment of the present invention provides a gobo platform including a baseplate including at least one aperture, and at least one gobo including a plurality of points of active retention configured to retain the at least one rotatable gobo holder on the baseplate.

Still another embodiment of the invention provides a gobo platform including a baseplate having at least one aperture, and at least one rotatable gobo holder having a means for retaining the gobo holder to the gobo platform.

Other aspects and advantages of the present invention will become apparent from the following detailed description, which, when taken in conjunction with the drawings, illustrate by way of example the principles of the present invention.

BRIEF DESCRIPTION OF THE DRAWINGS

For a fuller understanding of the nature and advantages of the present invention, as well as a preferred mode of use, reference should be made to the following detailed description read in conjunction with the accompanying drawings, in which.

DETAILED DESCRIPTION OF THE INVENTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of improved gobo retaining elements making up means for retaining, as well as operation and/or component parts thereof. While the following description will be described in terms of gobo elements, systems, etc. for clarity and to place the invention in context, it should be kept in mind that the teachings herein may have broad application to all types of systems, devices and applications.

The preferred embodiments of the present invention provide rotatable gobo assemblies including a rotatable baseplate, or carrier, having at least one aperture disposed therein, and at least one removable, rotatable gobo holder, the gobo holder having a plurality of points of active retention configured to retain the at least one removable, rotatable gobo holder on the baseplate. The preferred embodiments of the present invention, improve the known holder assemblies, but still hold the removable, rotatable gobo holders so that the gearing assemblies of the gobo holders of the preferred embodiments mate with the gearing assemblies of the light fixtures as previously known in the art. The preferred embodiments of the present invention remove the spring retainer or flexible fingers from the rotatable baseplate used in the prior art so that the holder assemblies of the preferred embodiments of the present invention can be applied.

Figure 1:
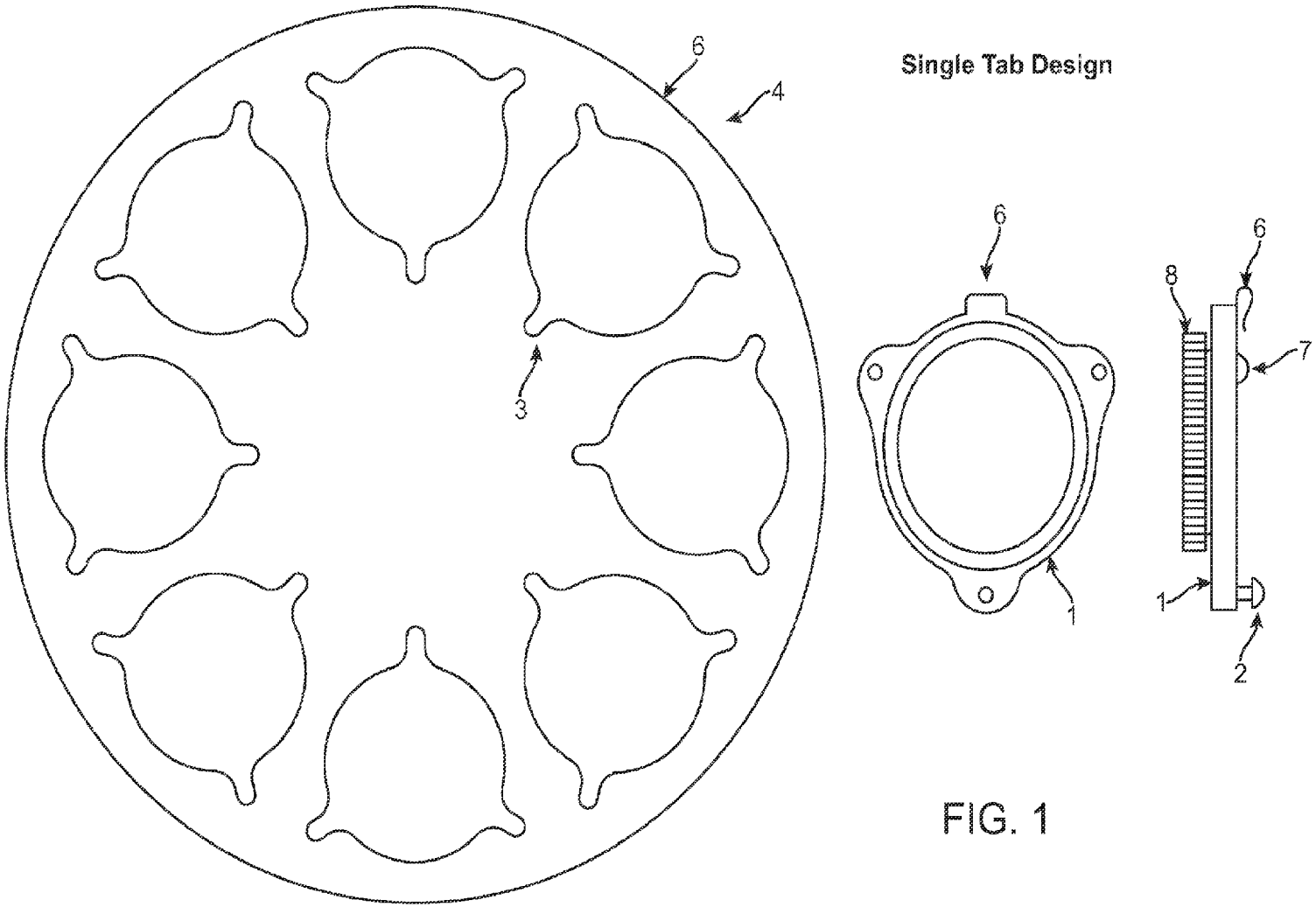
FIG. 1 illustrates one embodiment of a gobo platform apparatus according to a preferred embodiment of the present invention.

FIG. 1 illustrates an embodiment of a removable, rotatable gobo holder assembly of a first preferred embodiment of the present invention. In this first embodiment the removable, rotatable gobo holder 1 includes a screw key 2, which mates with a through notch 3 within the rotatable baseplate 4 to create a first point of active retention. The gobo holder 1 has a second point of active retention in metal retention spring clip 5 that wraps around the outer circumference 6 of the rotatable baseplate 4 to hold the removable gobo holder assembly 1 in place. The bottom of the gobo holder 1 of this first embodiment may also include nipples 7 which may act to stabilize the gobo holder 1 on the rotatable base plate 6.

In one example of this first embodiment, the retention spring clip 5 mates with a notched indentation (not shown) on the reverse side of the rotatable baseplate 4, which can form another point of active retention horizontally with respect to the bottom of the rotatable baseplate 4.

In the first embodiment of the present invention illustrated in FIG. 1, a first point of retention is the screw key 2. In one embodiment the screw key 2 has a fixed height. In another embodiment, the screw key 2 can vary in height in relation to the rotatable baseplate 4. Notch 3 provides a locking portion adapted to lock the screw key with the rotatable baseplate 4.

The rotatable, removable gobo holder 1 also includes gearing portion 8 which drives the gobo inside the gobo holder 1. The gear 8 interacts with the gearing assembly at the baseplate 4 to drive the rotation of the gobo within the gobo holder 1.

Figure 2:
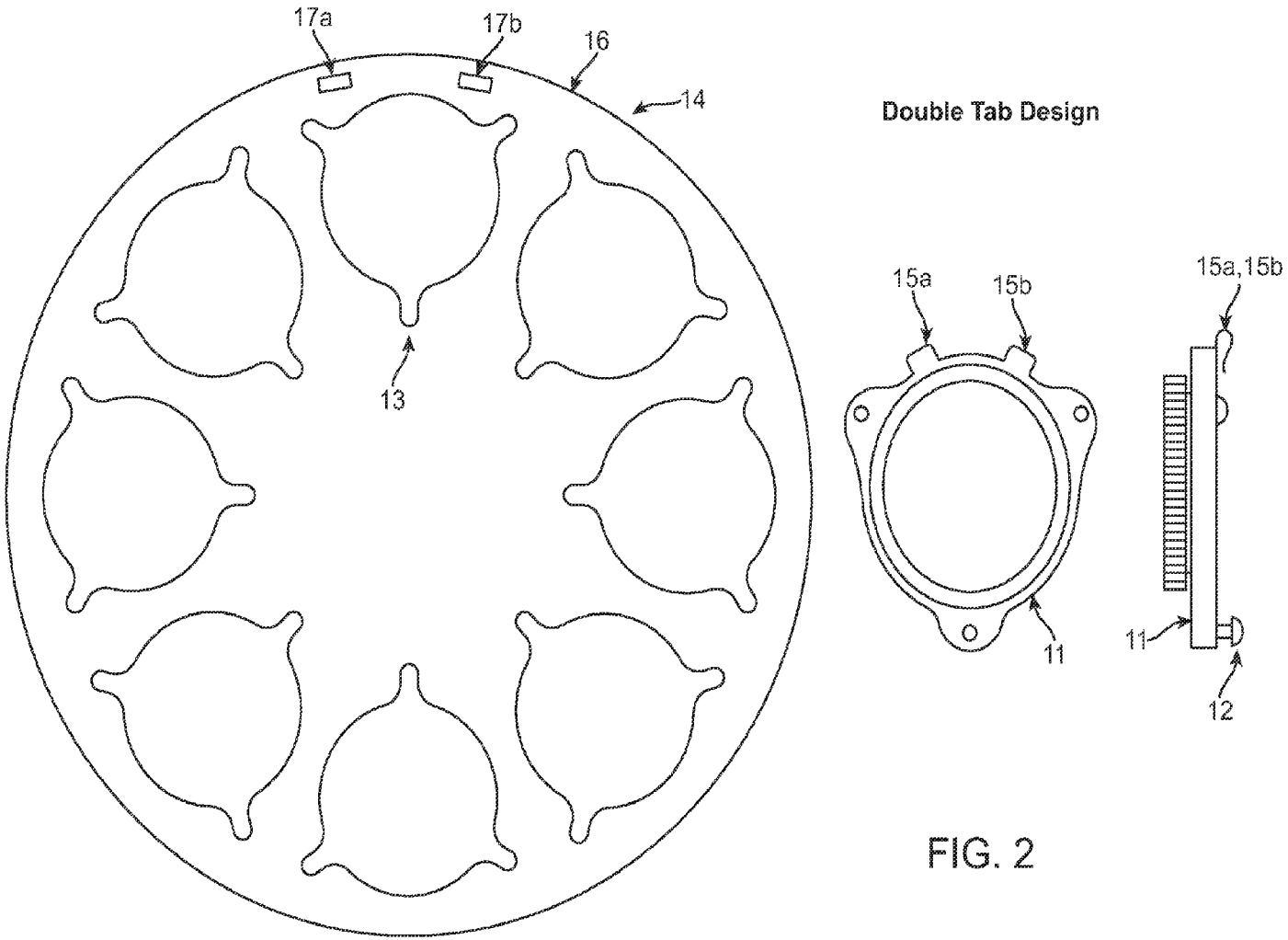
FIG. 2 illustrates another embodiment of a gobo platform apparatus according to a preferred embodiment of the present invention.

FIG. 2 illustrates an embodiment of a removable, rotatable gobo assembly 14 which may be used with a second embodiment of the present invention. The gobo holder 11 includes a screw key 12, which mates with a through notch 13 within the baseplate 14 to create a first point of active retention. The gobo holder 11 also has second and third points of active retention, which are metal retention spring clips 15*a* and 15*b* that wrap around the outer circumference 16 of the rotatable baseplate 14 to hold the removable gobo holder assembly 11 in place. In this embodiment, the retention spring clips 15*a* and 15*b* may mate with notched indentations 17*a* and 17*b* on the reverse side of the rotatable baseplate 14, which forms another point of active retention horizontally with respect to the bottom of the rotatable baseplate 14. In this embodiment the indentations 17*a* and 17*b* form a means for locking the spring clips 15*a* and 15*b* in place.

Figure 3:
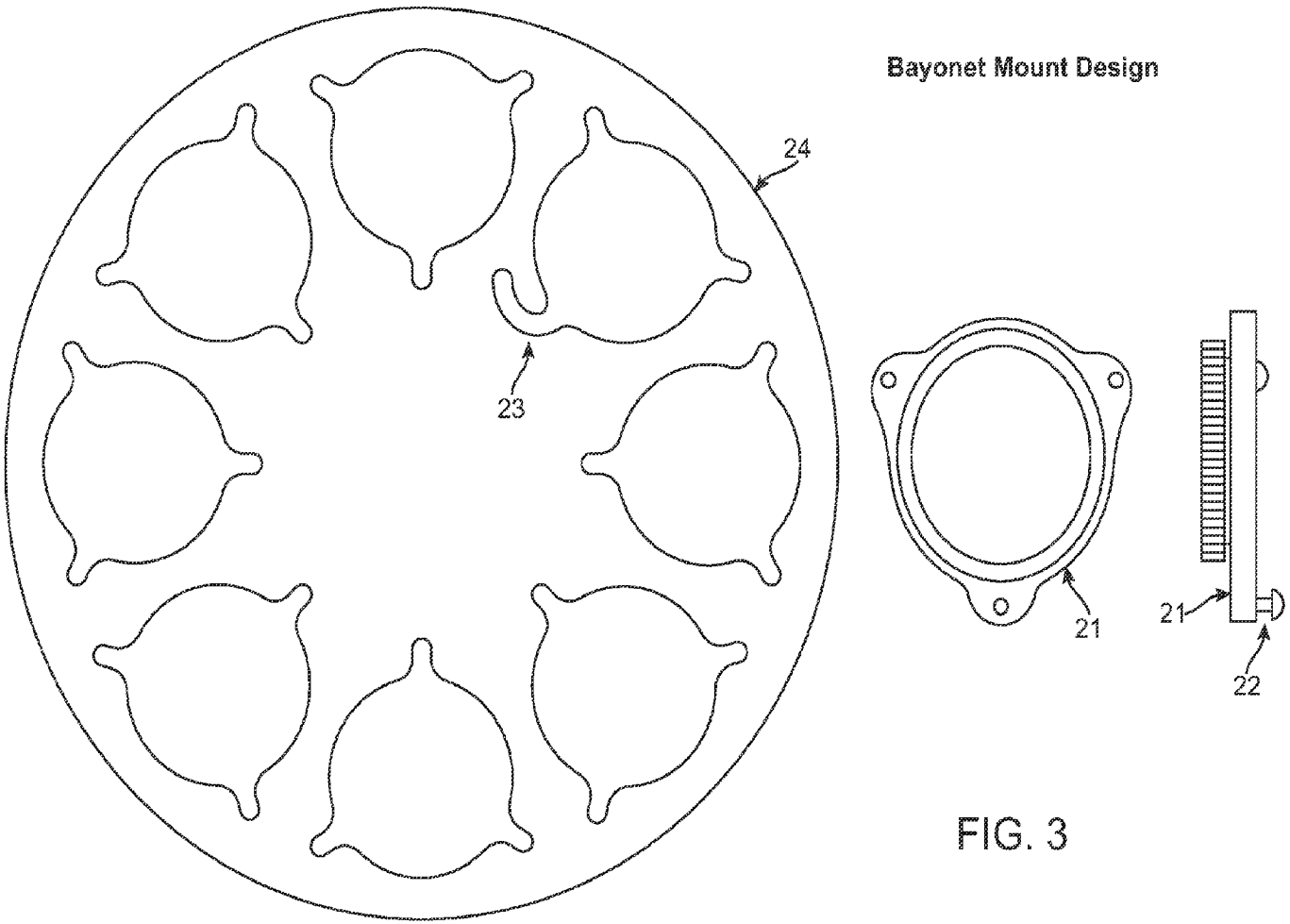
FIG. 3 illustrates yet another embodiment of a gobo platform apparatus according to a preferred embodiment of the present invention.

FIG. 3 illustrates an embodiment of a removable, rotatable gobo assembly of a third embodiment of the present invention. This third embodiment includes multiple points of active retention from the gobo holder 21 that include one or more screw keys 22 that are configured to fit into notched recesses 23 on the baseplate 24. Once the screw keys 22 are fitted into notched recesses 23 the rotatable gobo holder is rotated to lock into place on the baseplate 24 through a bayonet type mount which allows one or more points of active retention. In this embodiment, a single screw key 22 may be opposed on the baseplate 24 from multiple directions and/or a locking mechanism to lock the single screw key 22 into place. Multiple forces or points of retention can thereby arise from a single screw key or the screw key can be opposed by another locking mechanism to provide further multiple points of retention.

Figure 4:
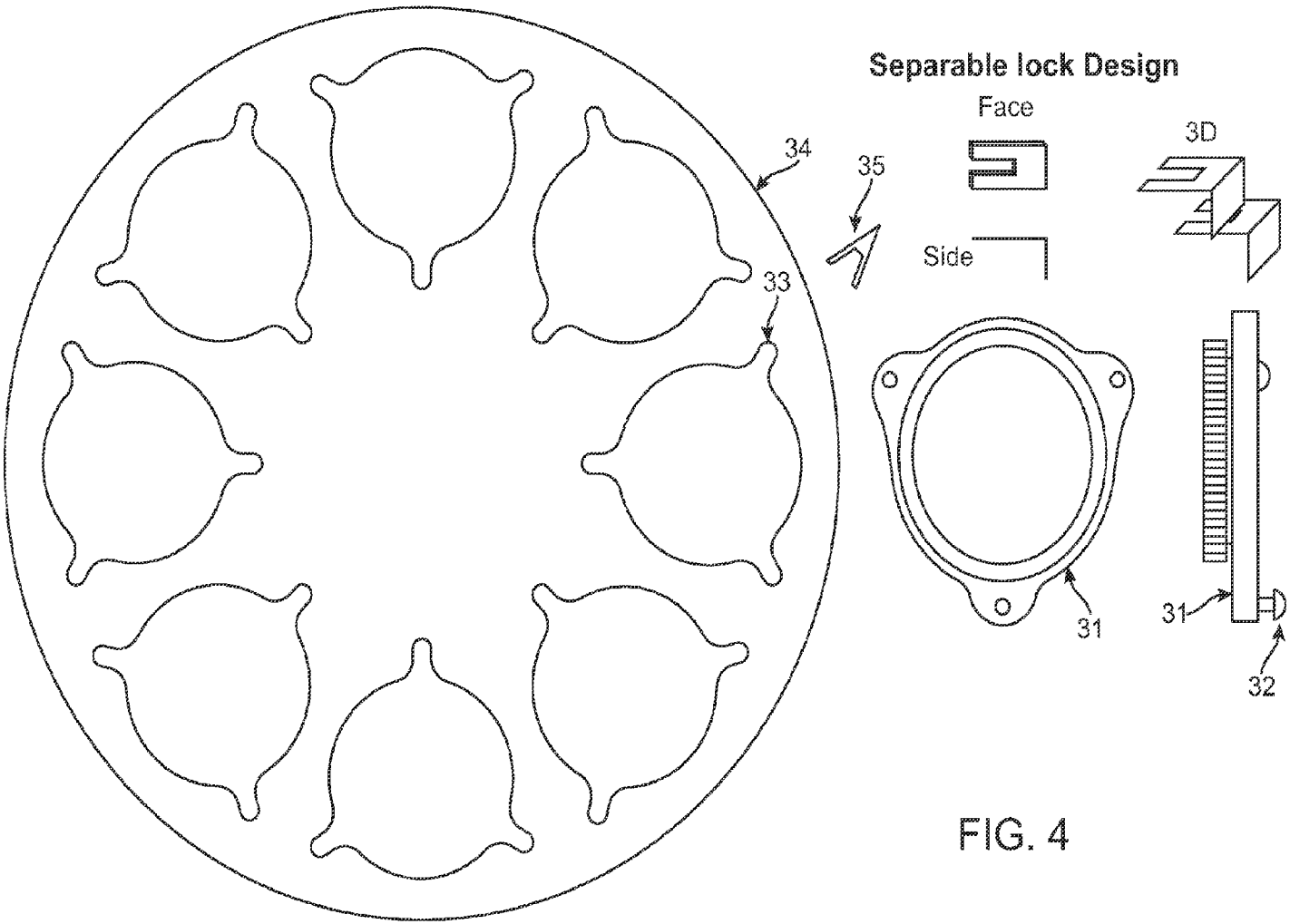
FIG. 4 illustrates still another embodiment of a gobo platform apparatus according to a preferred embodiment of the present invention.

FIG. 4 illustrates an embodiment of a removable, rotatable gobo assembly of a fourth preferred embodiment of the present invention. In this fourth embodiment, multiple points of active retention on the removable gobo holder 31 include one or more screw keys 32 that fit into notched recesses 33 on the baseplate 34, and are secured in place by a third separable locking mechanism 35. The third separable locking mechanism 35 can be in the form of a thin metallic plate, which keys or slides into place along the rotatable base plate to lock one or more of the screw keys into place.

The third separable locking mechanism 35 may be square or angular but can have multiple tines to wedge the screw key 32 in place. A lip may align with the baseplate's 34 circumference to provide an easy way to pull the separable locking mechanism 35 away for easy removal. In this fourth embodiment, a single screw key 32 may be opposed on the baseplate 34 from multiple directions. Multiple forces or points of retention can thereby arise from a single screw key 32 or the screw key 32 may be opposed by another locking mechanism to also provide multiple points of retention.

Figure 5:
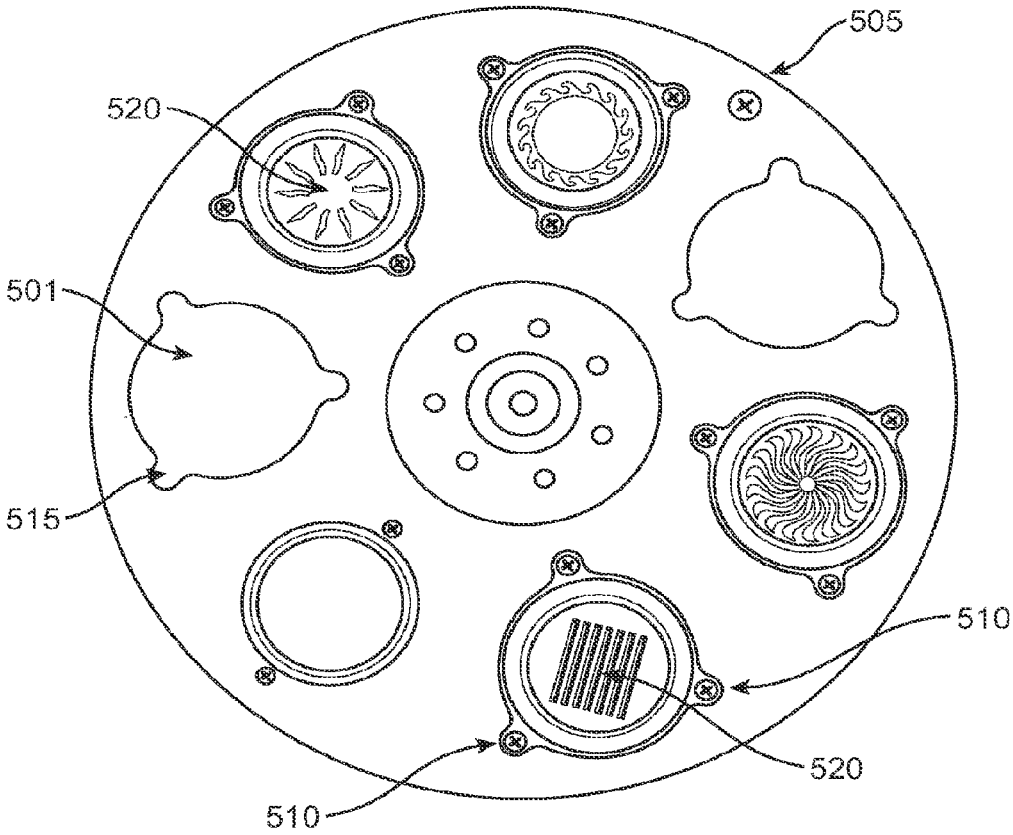
FIG. 5 illustrates a bottom view of an embodiment of a gobo platform apparatus according to a preferred embodiment of the present invention.

FIG. 5 illustrates a bottom view of a fifth embodiment of a rotatable gobo baseplate 505 in accordance with a fifth preferred embodiment of the present invention having apertures 501 and removable, rotatable gobo holders 520 disposed therein. In this fifth embodiment, baseplate 505 is rotatable. As illustrated, removable, rotatable gobo holder 520 includes a screw key 510 by which the gobo holder 520 is coupled to the base plate 505. In this fifth embodiment, screw key 510 is simply a screw head that is configured to fit into notch 515 to prevent horizontal movement of the gobo holder relative to the baseplate 505.

Figure 6B:
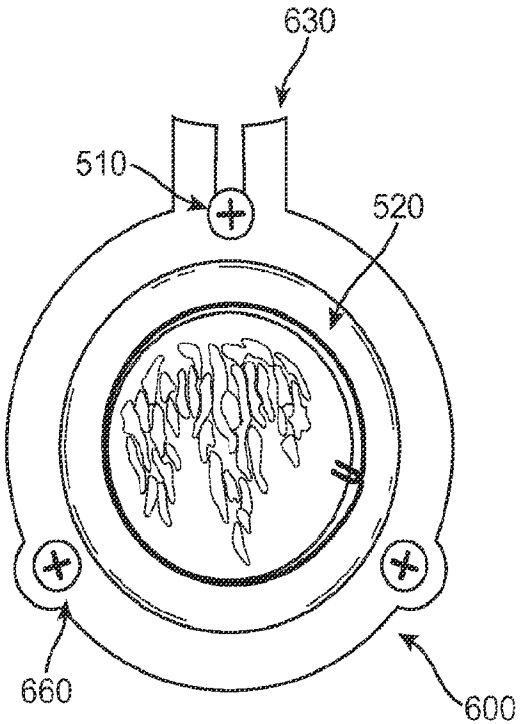
FIG. 6B illustrates a bottom view of the embodiment illustrated in FIG. 6A.
Figure 6A:
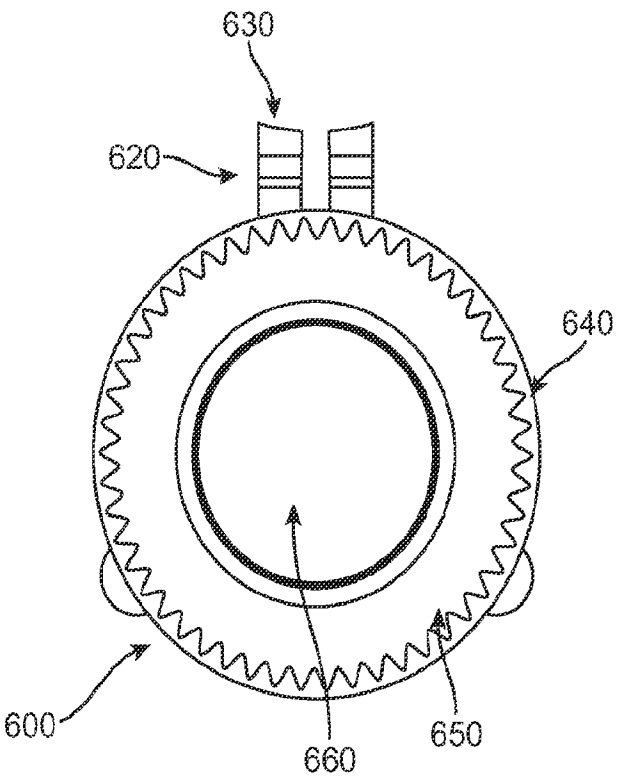
FIG. 6A illustrates a top view of an embodiment of a rotatable gobo holder apparatus mateable with the gobo platform preferred embodiment of the present invention shown in FIG. 5.

FIG. 6A illustrates a top view of an embodiment of removable, rotatable gobo holder 600 removed from rotatable baseplate 505, shown in FIG. 5. As illustrated, the removable, rotatable gobo holder 600 includes a gear portion 650 configured to spin the gobo 660 by turning a rotatable portion of gobo holder 600 in relation to a stationary portion of gobo holder 600. Gobo holder 600 has a top portion 640 coupled to a base portion 520.

In this embodiment, the second point of active retention is an extension arm 630 including a raised locking portion 620. In one embodiment the extension arm 630 includes two extending portions. In another embodiment (not shown) extension arm 630 includes only a single extending portion.

FIG. 6B illustrates a bottom view of an embodiment of a removable, rotatable gobo holder 600. As illustrated, key 510 are connected to the gobo holder 660.

Figure 7:
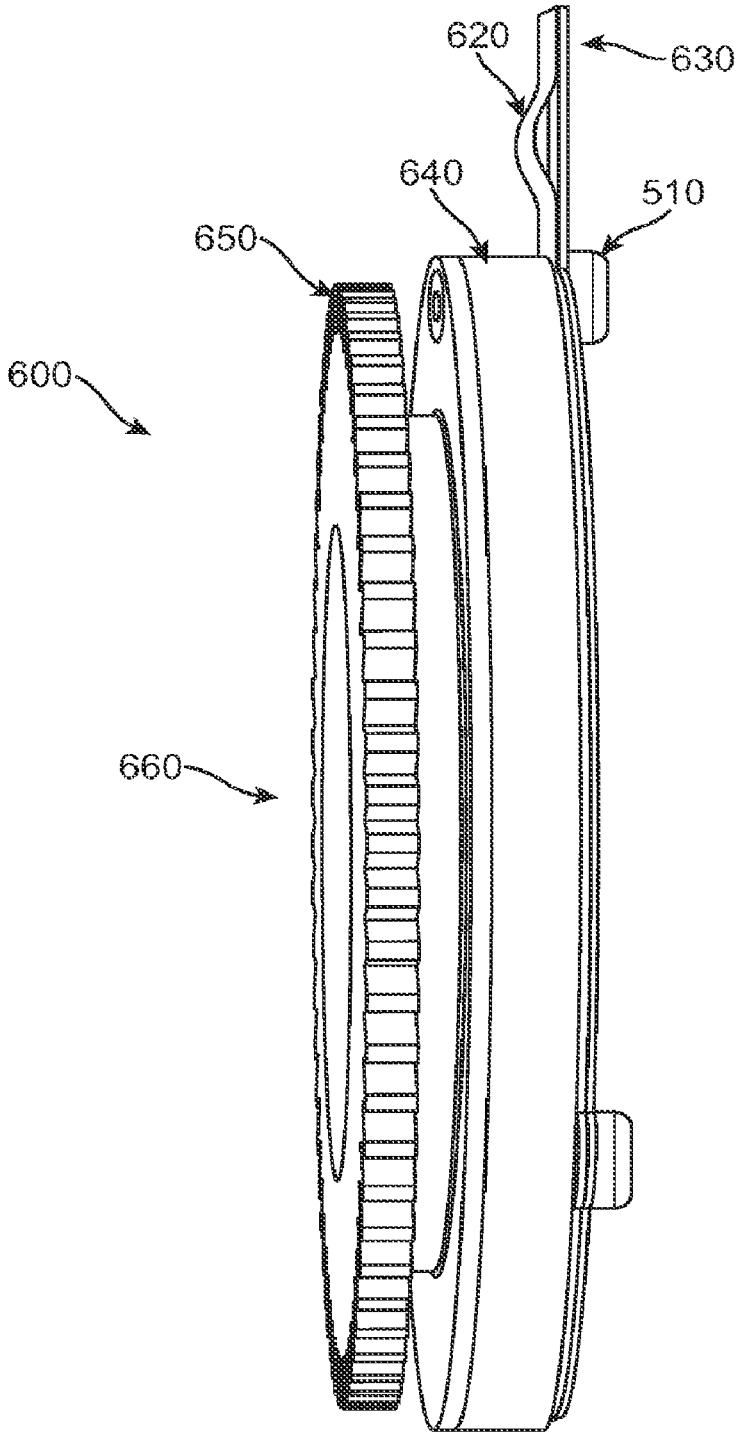
FIG. 7 illustrates a side view of the embodiment illustrated in FIG. 6A.

FIG. 7 illustrates a side view of the removable, rotatable gobo holder 600 shown in FIG. 6 including gobo holder 660 and extension arm 630 having a raised locking portion 620. The extension arm 630 may include multiple or single raised portions that contract/expand when force is placed upon them. This realizes a means for active retention when coupled to the baseplate 505. The extension arm 630 is configured to removably lock with a locking portion 810 (see FIG. 8).

Figure 8:
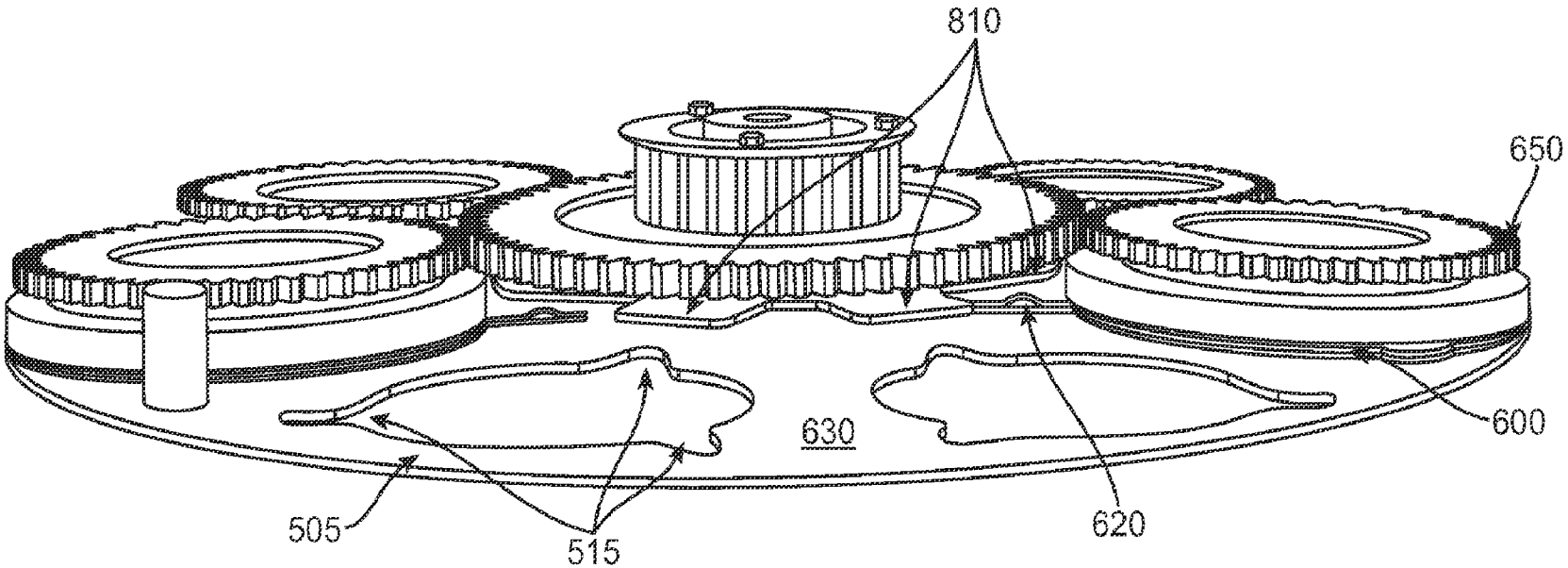
FIG. 8 illustrates a plane view of the gobo platform apparatus shown in FIGS. 5-7 with a rotatable gobo holder engaging the gobo holder platform according to a preferred embodiment of the present invention.

FIG. 8 illustrates a plane view of a gobo platform 505 of the preferred embodiment illustrated in FIG. 5. As illustrated, this embodiment includes a number of holding portions 810. The holding portions are displaced from the gobo platform 505 and extend outwardly from the central axis of the gobo platform 505.

In this embodiment, the removable, rotatable gobo holder 600 is attached to the baseplate 505 through extension arm 630 that is inserted under one of a plurality of holding portions 810. As illustrated, when a removable, rotatable gobo holder 600 is inserted onto the baseplate 505 to lock the raised portion 620 of extension arm 630 with a holding portion 810, raised portion 620 is displaced downwards and outwards a small distance. The raised portion 620 is therefore forced into connection with a holding portion 810.

In this embodiment, keys 510 (shown in FIG. 7) also act as means for retention to lock the removable, rotatable gobo holder 660 onto baseplate 505. To remove a gobo holder 660 from the baseplate 505, the gobo holder must be first raised to allow movement away from the center of the baseplate 505 to allow the keys 510 located towards the outer edge of the baseplate 505 to become unlocked from the notches 515.

Figure 9:
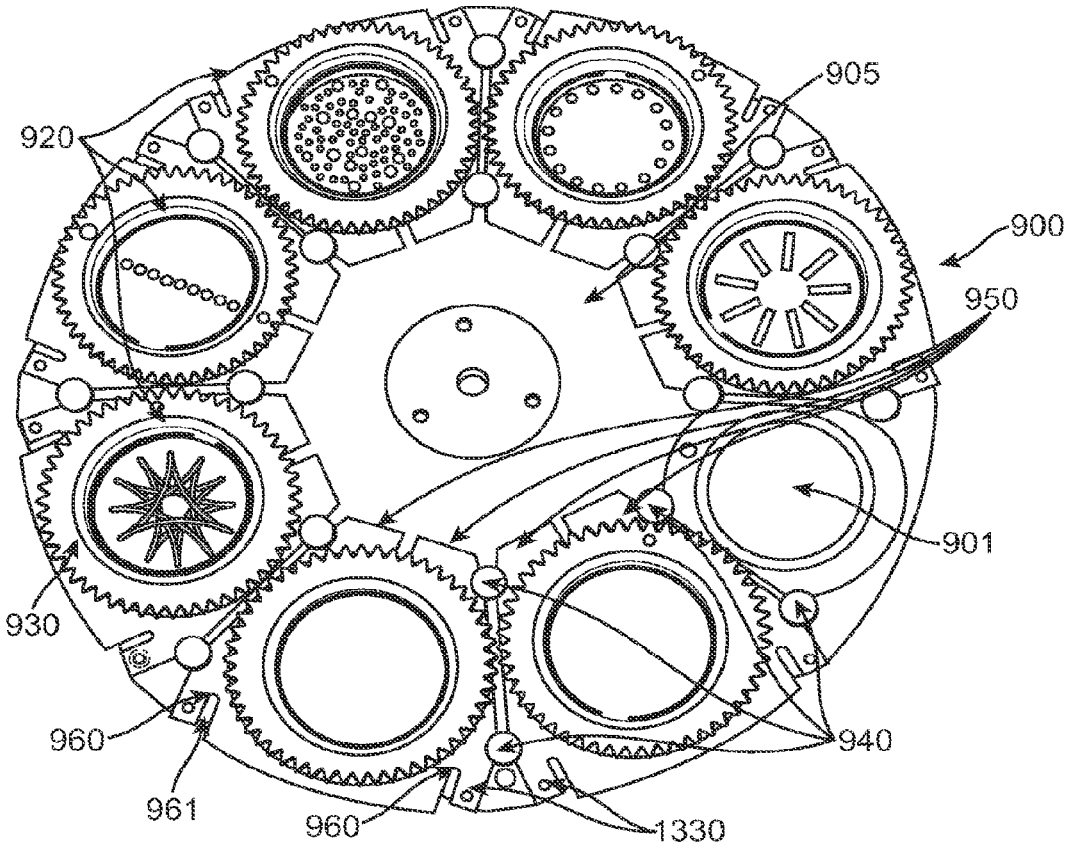
FIG. 9 illustrates a top view of another embodiment of a gobo platform apparatus according to a preferred embodiment of the present invention.

FIG. 9 illustrates another preferred embodiment of a gobo platform 900 according to the present invention. In this embodiment, the removable, rotatable gobo holders 920 including rotatable portion 930. As illustrated, seven removable, rotatable gobo holders 920 are attached to a baseplate 905. The baseplate 905 has an outer circumference 910 and an aperture 901. Aperture 901 allows the baseplate 905 to be rotated into position so that the light path can pass through the baseplate 905 without being imaged by a gobo.

In this embodiment, the baseplate 905 includes many raised holding portions 940 that are raised to accommodate a thickness of a base portion of a removable, rotatable gobo holder 920. Gobo holder 920 includes a conformable portion 950 including at least two split portions that allow gobo holder 920 to be inserted between opposite holding portions 940. When inserted between holding portions 940, the conformable portion 950 is compressed to place a force onto holding portions 940 through compression and expansion.

In this preferred embodiment, another conformable portion 960 includes a channel 961 that allows this conformable portion 960 to compress to place a force onto associated holding portions 940. In this preferred embodiment of the invention, the baseplate 905 further includes indentations 1010 (shown in FIG. 11) that allow a raised portion 1330 (shown in Fig. on the bottom of the gobo holder 920 to snap into place. This forms another means of active retention by locking the raised portion 1330 in the indentation 1010 for additional securing means.

Figure 10:
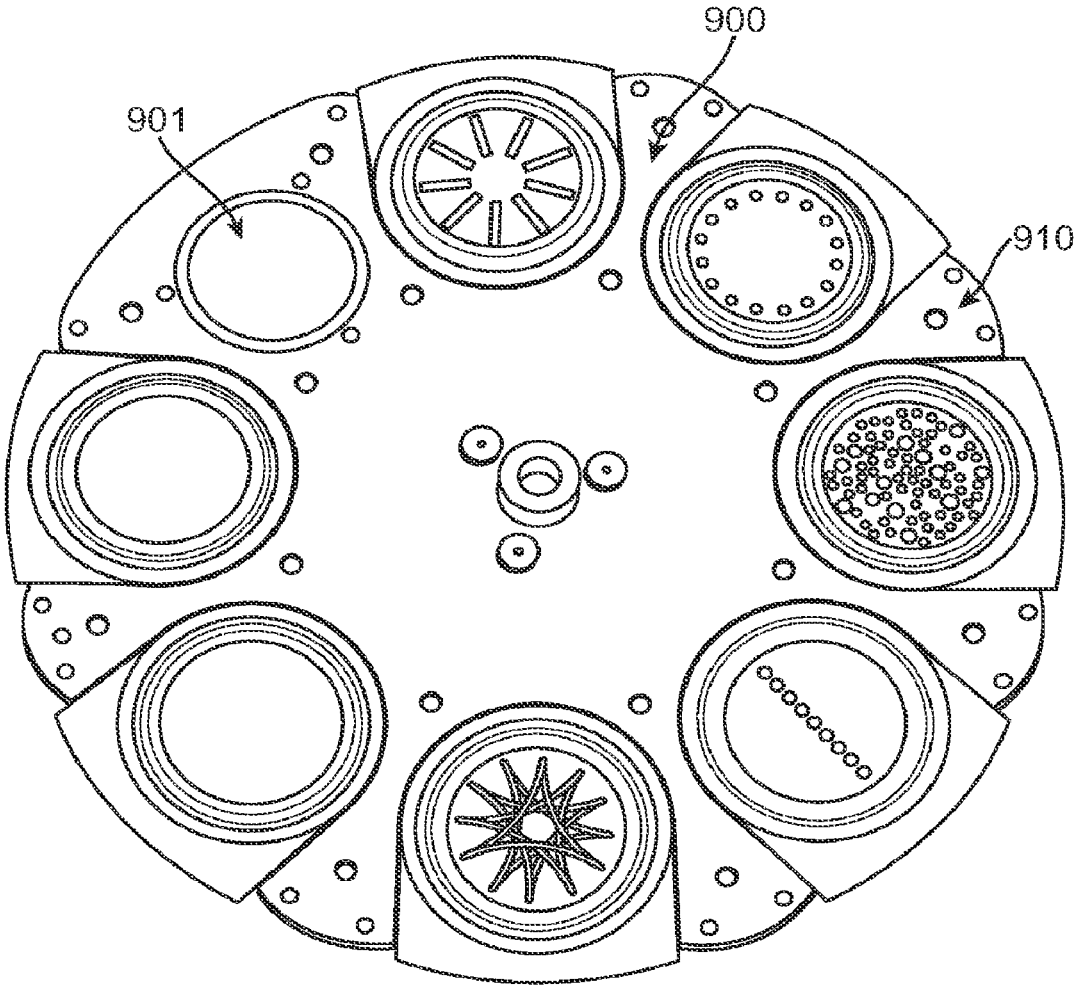
FIG. 10 illustrates a bottom view of the embodiment of the present invention illustrated in FIG. 9.

FIG. 10 illustrates a bottom view of gobo platform 900 of the embodiment shown in FIG. 9. In this preferred embodiment, conformable portions 960 includes a raised locking portion 1330 (see FIG. 13) that removably locks into a groove or through hole 1010.

Figure 11:
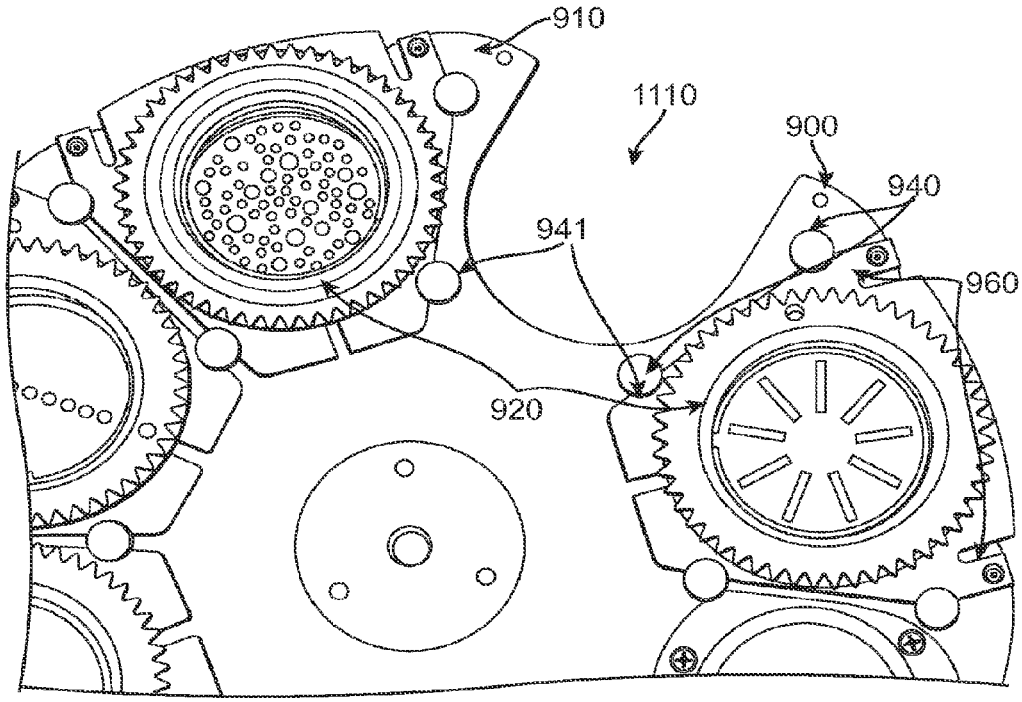
FIG. 11 illustrates the embodiment of the present invention illustrated in FIG. 9 with a rotatable gobo holder removed.

FIG. 11 illustrates gobo platform 900 with one removable, rotatable gobo holder 920 removed. As illustrated, the aperture 1110 where a gobo holder 920 fits has an open end portion. In this preferred embodiment, the gobo holder 920 is inserted onto the baseplate 910. The holding portions 940 and raised locking portions 1330 retain the gobo holder onto the baseplate 910. The head of the holding portions 940 are spaced from the baseplate 910 to create a notch 941 for the removable, rotatable gobo holder 920 to fit within and be held in place.

In order to remove the gobo holder 920 from baseplate 910, the rear portion of the removable, rotatable gobo holder 920 including the conformable portion 960 must be raised to allow the raised locking portions 1330 to release the gobo holder 920 horizontally in relation to the baseplate 910. In one embodiment of the invention, the gobo holder must be raised enough to allow the raised portions on the base portion of gobo holder 920 to be released from retention.

Figure 12:
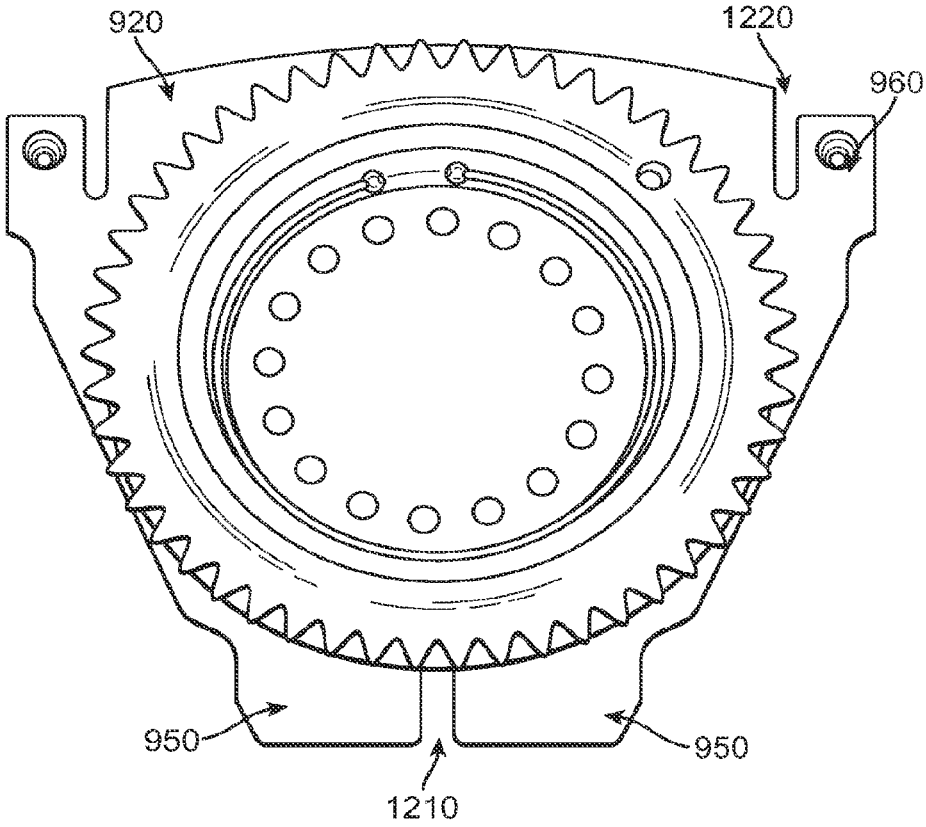
FIG. 12 illustrates a top view of one embodiment of a rotatable gobo holder mateable to the embodiment of the invention shown in FIGS. 9-11.
Figure 13:
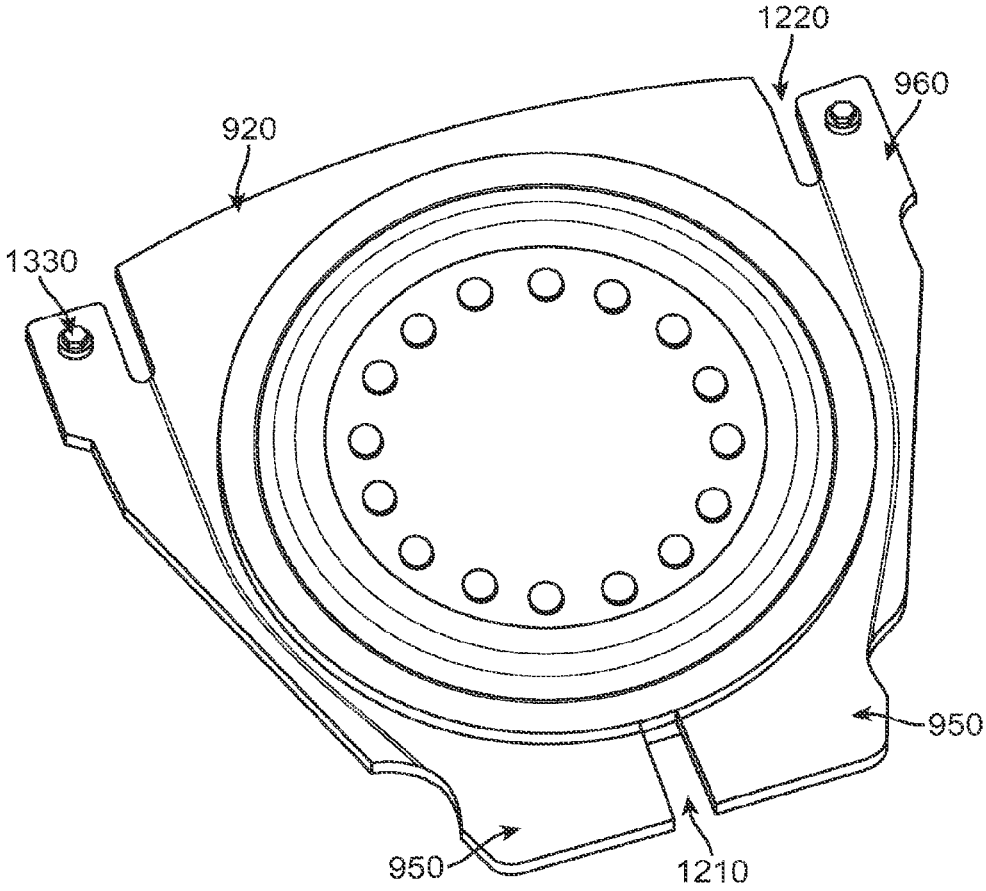
FIG. 13 illustrates a bottom view of the rotatable gobo holder embodiment illustrated in FIG. 12.

FIG. 12 illustrates a top view of a preferred embodiment of a removable, rotatable gobo holder 920 including a gobo as used in the embodiment shown in FIGS. 9-11. As illustrated in FIGS. 12-13, the conformable portions 950 include a gap or channel 1210 allowing the split portions of the conformable portion 950 to be compressed. As also illustrated, the conforming portion 960 includes a gap or channel 1220 allowing the split portions of the conformable portion 960 to be compressed. FIG. 13 illustrates a bottom view of the removable, rotatable gobo holder 920 of FIG. 12. As illustrated, conforming portion 960 includes a raised locking portion 1330 that is configured to removably lock with a groove or through hole 1010 (shown in FIG. 9-11).

One preferred embodiment of the invention includes a rotatable baseplate and at least one removable, rotatable gobo holder which fits within an aperture in the baseplate, and means for active retention affixed to the gobo holder to hold the gobo holder to the baseplate. The means for active retention exerts force onto the rotatable baseplate to maintain the gobo holder in place within the aperture. The means for active retention can vary and encompass at least the previous mentioned embodiments including alternative retaining mechanisms.

Another embodiment of the invention includes a rotatable gobo holder including means for holding a gobo and means for active retention to engage a rotatable baseplate having an aperture to maintain the rotatable gobo holder in place within the aperture. In this embodiment, the gobo holder is easily removed from the baseplate and also is prevented from dislodging or falling out/off of the baseplate.

Yet another embodiment of the invention includes a method for attaching a removable, rotatable gobo holder to a rotatable baseplate. The method includes positioning the gobo holder into an aperture in the rotatable baseplate and engaging a means for active retention on the rotatable gobo holder onto the rotatable baseplate. The means for active retention may engage a coupling means on the baseplate. The means for active retention can include any of the shown embodiments.

The above described embodiments cost less to manufacture than the prior art removable, rotatable gobo holder systems. The above described means for retaining a gobo holder to a baseplate decrease the likelihood a gobo holder would be jarred loose from a baseplate. Additionally, the above-described embodiments do not include a spring retainer means affixed to the baseplate, which wears out and loses compression. The various removable, rotatable gobo holders of the preferred embodiments of the invention can be attached to a base plate and removed without the need of hand tools or removing the baseplate or the lighting fixture. This makes changing damaged gobo holders or changing to a different gobo in a gobo holder quicker and easier than the prior art. Further, by moving the means of active retention, which engages to hold the removable, rotatable gobo holder in place on the baseplate, from the stationary baseplate to the removable gobo holder, the frequent basis for reparation is also moved from the baseplate and/or the lighting fixture onto the gobo holder, which is removable and easily repaired or replaced.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A rotatable gobo platform comprising:

a rotatable baseplate including at least one aperture; and at least one rotatable gobo holder including at least two points of active retention affixed to the at least one gobo holder, wherein each point of active retention is configured to engage the rotatable baseplate and exert a holding force onto the rotatable baseplate to retain the at least one rotatable gobo holder on the rotatable baseplate.

2. The rotatable gobo platform of claim 1, wherein a first point of retention is a key.

3. The rotatable gobo platform of claim 2, wherein the key has a fixed height.

4. The rotatable gobo platform of claim 2, wherein the key has an adjustable height.

5. The rotatable gobo platform of claim 2, further comprising a locking portion adapted to lock the key with the rotatable baseplate.

6. The rotatable gobo platform of claim 1, wherein a second point of active retention is at least one retention clip.

7. The rotatable gobo platform of claim 6, wherein the rotatable baseplate including a portion to receive the at least one retention clip.

8. The rotatable gobo platform of claim 1, wherein the rotatable baseplate including a portion configured to couple with a first point of active retention.

9. The rotatable gobo platform of claim 8, wherein the portion configured to couple with the first point of active retention is a retaining notch.

10. The rotatable gobo platform of claim 9, wherein the rotatable baseplate including a holding portion configured to couple with a second point of active retention.

11. The rotatable gobo platform of claim 10, wherein the second point of active retention is an extension arm including a raised locking portion.

12. The rotatable gobo platform of claim 1, wherein the rotatable baseplate includes a plurality of raised holding portions.

13. The rotatable gobo platform of claim 12, wherein the rotatable baseplate includes a plurality of recessed holding portions.

14. The rotatable gobo platform of claim 12, wherein a first point of active retention is a first conformable portion configured to be retained by at least two of the plurality of raised holding portions.

15. The rotatable gobo platform of claim 14, wherein a second point of active retention is a second conformable portion configured to be retained by at least two other of the plurality of raised holding portions.

16. The rotatable gobo platform of claim 14, wherein a second point of active retention is a plurality of raised locking portions configured to be retained in complementary through holes portion in the rotatable baseplate.

17. The rotatable baseplate of claim 1, wherein the at least one aperture has is circumference including an open end portion.

18. A gobo platform comprising:

a baseplate including at least one aperture; and at least one gobo holder including a plurality of points of active retention affixed to the at least one gobo holder, wherein each point of active retention is configured to engage the baseplate and exert a holding force onto the baseplate to retain the at least one gobo holder on the baseplate.

19. The gobo platform of claim 18, wherein a portion of the plurality of points of active retention is one or more keys.

20. The gobo platform of claim 19, wherein the baseplate includes one or more locking portions adapted to retain the one or more keys.

21. The gobo platform of claim 19, wherein another portion of the plurality of points of active retention is at least one retention clip configured to removably couple with the baseplate.

22. The gobo platform of claim 19, wherein another portion of the plurality of points of active retention is an extension arm including a raised locking portion.

23. The gobo platform of claim 18, wherein the baseplate includes a plurality of raised holding portions.

24. The gobo platform of claim 23, wherein the baseplate includes a plurality of recessed holding portions.

25. The gobo platform of claim 24, wherein one of the points of active retention is one or more conformable portions configured to be retained by at least two of the plurality of raised holding portions.

26. A gobo platform comprising:

a rotatable baseplate including at least one aperture; and at least one removable, rotatable gobo holder, the gobo holder having a means for active retention affixed thereto for engaging the baseplate and exerting a holding force onto the baseplate for retaining the rotatable gobo holder to the baseplate.

27. A rotatable gobo assembly, comprising:

a rotatable baseplate including at least one aperture;

at least one removable, rotatable gobo holder fitting within the aperture; and means for active retention affixed to the gobo holder, the means for active retention engaging the rotatable baseplate and exerting a holding force onto the rotatable baseplate to maintain the gobo holder in place within the aperture.

28. A rotatable gobo holder, comprising:

means for holding a gobo; and means for active retention affixed to the gobo holder for engaging a rotatable baseplate having an aperture, the means for active retention exerting a holding force onto the rotatable baseplate for maintaining the rotatable gobo holder in place within the aperture.

29. A method for coupling a removable, rotatable gobo holder to a rotatable baseplate, the method comprising:

positioning the rotatable gobo holder over an aperture in the rotatable baseplate; and engaging a means for active retention affixed to the rotatable gobo holder, the means of active retention exerting a holding force onto the rotatable baseplate to maintain the gobo holder in place within the aperture.

* * * * *